US007140300B2

(12) United States Patent
Minard et al.

(10) Patent No.: US 7,140,300 B2
(45) Date of Patent: Nov. 28, 2006

(54) DEVICE TO SEPARATE PROPELLANT CHARGE MODULES

(75) Inventors: Patrick Minard, La Chapelle Saint Ursin (FR); Robert Vernet, Bourges (FR); Julien Boutin, Istres (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 11/115,171

(22) Filed: Apr. 27, 2005

(65) Prior Publication Data

US 2005/0241469 A1 Nov. 3, 2005

(30) Foreign Application Priority Data

Apr. 29, 2004 (FR) ..... 04 04560

(51) Int. Cl.
*F42B 5/38* (2006.01)

(52) U.S. Cl. ..... 102/282; 89/45; 89/46

(58) Field of Classification Search ..... 89/45, 89/46; 102/282
See application file for complete search history.

(56) References Cited

U.S. PATENT DOCUMENTS 5,107,751 A 4/1992 Grabner
5,111,730 A 5/1992 Grabner
5,458,044 A * 10/1995 Delbos ..... 89/33.1
5,811,721 A * 9/1998 Andersson et al. ..... 89/45
5,831,201 A * 11/1998 Andersson et al. ..... 89/45
5,837,923 A 11/1998 Gay et al.
5,844,163 A 12/1998 Lindskog
6,048,159 A 4/2000 Nicolas et al.
6,073,534 A * 6/2000 Gagnon ..... 89/45
6,205,904 B1 3/2001 Boutet et al.

FOREIGN PATENT DOCUMENTS

FR 2 743 411 A2 7/1997
FR 2 743 413 A2 7/1997

* cited by examiner

*Primary Examiner*—Michael J. Carone
*Assistant Examiner*—Gabriel Klein
(74) *Attorney, Agent, or Firm*—Oliff & Berridge, PLC

(57) ABSTRACT

A device to separate propellant charge modules for field weapons, each module incorporating a top and bottom, the top of one of the modules being engaged in the bottom of an adjacent module, the device incorporating a reception device for all the modules having a device to immobilize each of the modules, the immobilizing device being linked by a linking and separating device enabling a relative translation to be controlled for each of the modules with respect to its neighbors, thereby ensuring the separation of the modules.

15 Claims, 10 Drawing Sheets

DEVICE TO SEPARATE PROPELLANT CHARGE MODULES

BACKGROUND

The technical scope of the present invention is that of devices enabling a mounted field weapon to be supplied with propellant charges in a given quantity.

It is known to supply a weapon using propellant charge modules generally grouped by six. According to operational needs, a certain number of modules, for example between three and six, must be used. It is thus necessary for the set of modules to be split and the required number removed. These selection operations are very difficult to manage when the modules are not physically linked together and quickly become unmanageable when the charge modules are supplied to the operators already linked.

Patent U.S. Pat. No. 6,048,159 describes an automatic pick up system for separate propellant charge modules stored in a magazine. No indication is given in this patent on the subsequent handling of these modules.

Patent U.S. Pat. No. 6,205,904 describes a device to supply field artillery with ammunition elements constituted by a projectile and separate propellant charge modules. In this device, the magazine is fitted with a lift enabling the removal of the number of modules required to be used.

Patent U.S. Pat. No. 5,837,923 describes a transfer device for the separate modules constituting the propellant charge to take them from a storage magazine to a system to load these modules into the chamber of a piece of field artillery. This device provides for the removal of all the modules stored in one row of the magazine indifferently.

Patent U.S. Pat. No. 5,844,163 describes a system to load propellant charge modules into a cannon, such modules being taken from a storage container. However, in this patent, the modules are stored in individual compartments and are taken in such numbers as required by the user. In other words, the modules are separated in the magazine but are then linked before loading.

As may be seen from these patents, the propellant charge modules are available separately in fixed quantities determined by the size of the artillery cannon magazine, and are then grouped together to be loaded in the cannon. None of these patents deals with the case of modules that are delivered already linked and which necessarily require separation afterwards for the required number to be taken.

SUMMARY

The aim of this invention is to provide a system that overcomes this drawback in prior art by enabling an artillery cannon to be supplied with the required number of modules, whether these modules be stored pre-linked or not.

The invention thus relates to a device to separate propellant charge modules for field weapons, each module incorporating a top and bottom, the top of one module being engaged in the bottom of an adjacent module, wherein it incorporates reception means for all the modules incorporating means to immobilize each module, these immobilizing means being linked by linking and separating means enabling a relative translation to be controlled for each module with respect to its neighbours, thereby ensuring the separation of the modules.

According to one characteristic of the device according to the invention, the immobilizing means are constituted by a set of pairs of pincers placed on either side of a module, each module being held by a pair of pincers, each pair of pincers being controlled in translation by the linking and separation means.

According to another characteristic of the device according to the invention, the linking and separating means comprise two screws incorporating a threaded shank opposite each module carrying a pincer, each screw being linked to drive means in rotation.

According to yet another characteristic of the device according to the invention, each screw comprises a first group of threaded shanks each having a different pitch in the same direction, and another group of threaded shanks each having a different pitch in the same direction, but in the opposite direction to those of the first group, the number of threaded shanks being the same as the number of propellant charge modules.

According to another characteristic, the threaded shanks in each group are of different diameters, the end shanks having a smaller diameter than that of the intermediate shanks whose diameter is less than that of the median shanks.

According to another characteristic, the pincers are constituted by jacks incorporating a body integral with a threaded shank and a jaw able to move with respect to said body.

According to yet another characteristic of the device according to the invention, the separated modules are transferred into a selection zone incorporating selection means for the modules that tip the selected modules into reception means.

Advantageously, the linking and separating means and the selection zone are arranged in the same case.

Advantageously again, the selection zone is provided with transversal walls defining a number of cells equal to the number of propellant charge modules separated by the separation means.

According to yet another characteristic of the device according to the invention, the modules are dropped into the selection zone.

According to yet another characteristic of the device according to the invention, the selection means for the modules are constituted by a set of pushers, each pusher being selectively controlled.

Advantageously, the reception means incorporate a reception bucket for individual modules, whose shape is such that it ensures the coaxial centering of the modules.

Advantageously again, the reception means are provided with means to assemble the modules able to engage the top of the module into the bottom of the adjacent module.

According to yet another characteristic of the device according to the invention, the module assembly means comprise a buffer able to move under the action of a jack and a fixed counter-buffer.

The fixed counter buffer may advantageously be tipped over with respect to the reception means.

A first advantage of the device according to the invention lies in the possibility of selecting at will the propellant charge modules to be loaded, whether they are stored linked or not.

Another advantage of the device according to the invention is that of absorbing the differences in diameter and length of the modules.

Another advantage lies in the simultaneous separation of all the modules, thereby satisfying the constraints linked to the firing rate.

Another advantage lies in the fact that a single actuator, acting on the endless screw, enables the modules to be separated, thereby reducing bulk.

Another advantage lies in the fact that since the cylinderless linear actuator is located under the reception bucket the overall bulk of the device can be reduced in spite of the long actuator stroke.

BRIEF DESCRIPTION OF THE DRAWINGS

Other characteristics, particulars and advantages of the invention will become more apparent from the following description given by way of illustration and in reference to the appended drawings, in which.

DETAILED DESCRIPTION OF EMBODIMENTS

The device according to the invention is intended to equip a weapon that is automatically supplied from a magazine 1 separately with projectiles and propellant charge modules.

Figure 1:
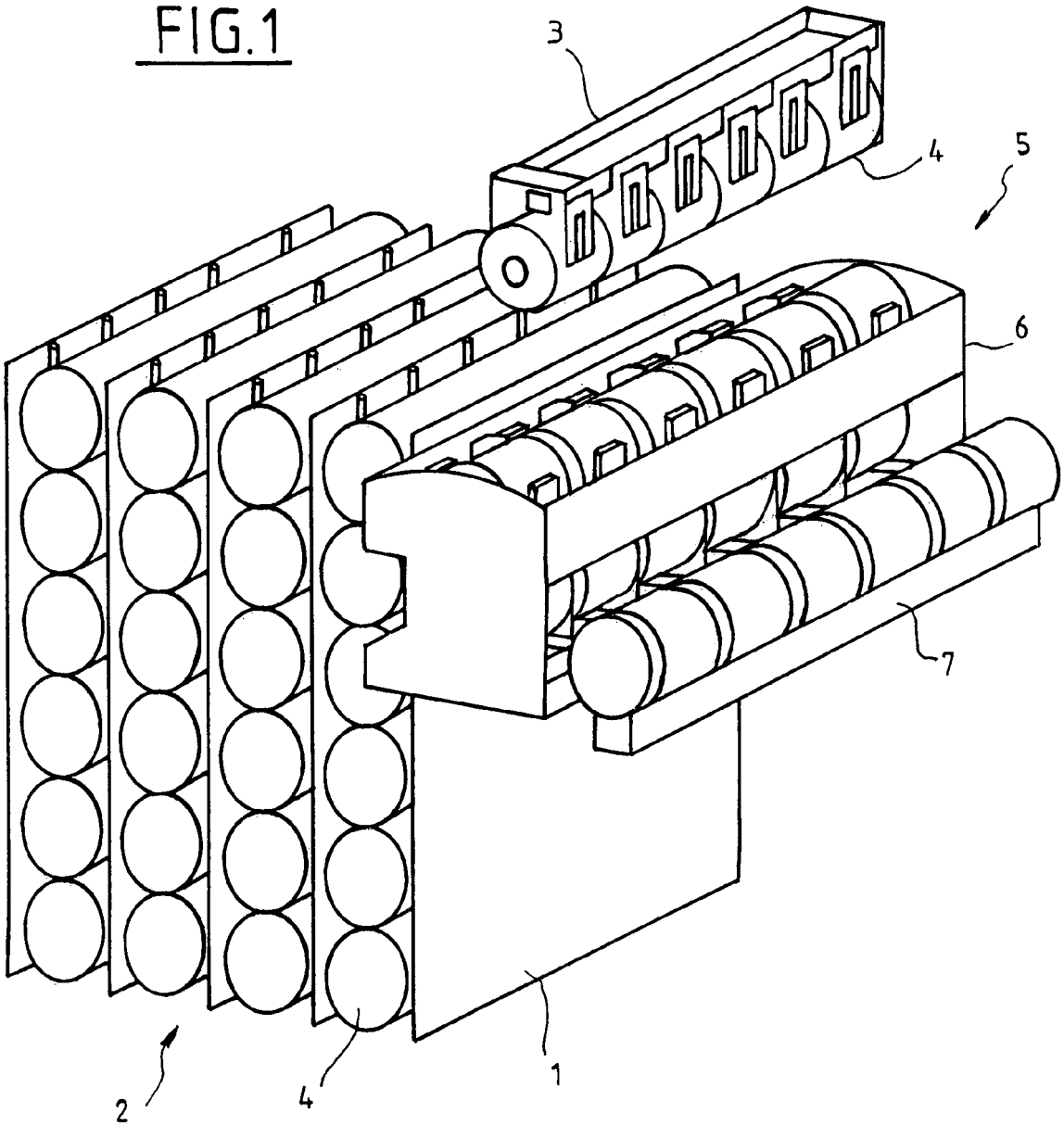
FIG. 1 shows a perspective view of the device according to the invention set against a propellant charge module magazine.

FIG. 1 shows the magazine 1 enclosing the rows 2 of propellant charge modules 4. On the top of the magazine 1, the handling device 3 can be seen loaded with a row of modules 4. This handling device 3 picks up a row of propellant charge modules 4 from the magazine and conveys it to the device 5 according to the invention. The structure and function of such a handling device is well known. It is the subject of patent FR2842893 and does not require further description. Naturally, these different elements are joined together by known means to which this invention does not relate.

The device 5 according to the invention comprises a case 6 and means 7 to join the modules. The case 6, in its upper part 6*a*, contains means 11 to receive and immobilize the modules, means to join and separate them as well as immobilizing means. The case 6, in its lower part 6*b*, comprises a selection zone 10 for the modules.

Figure 2:
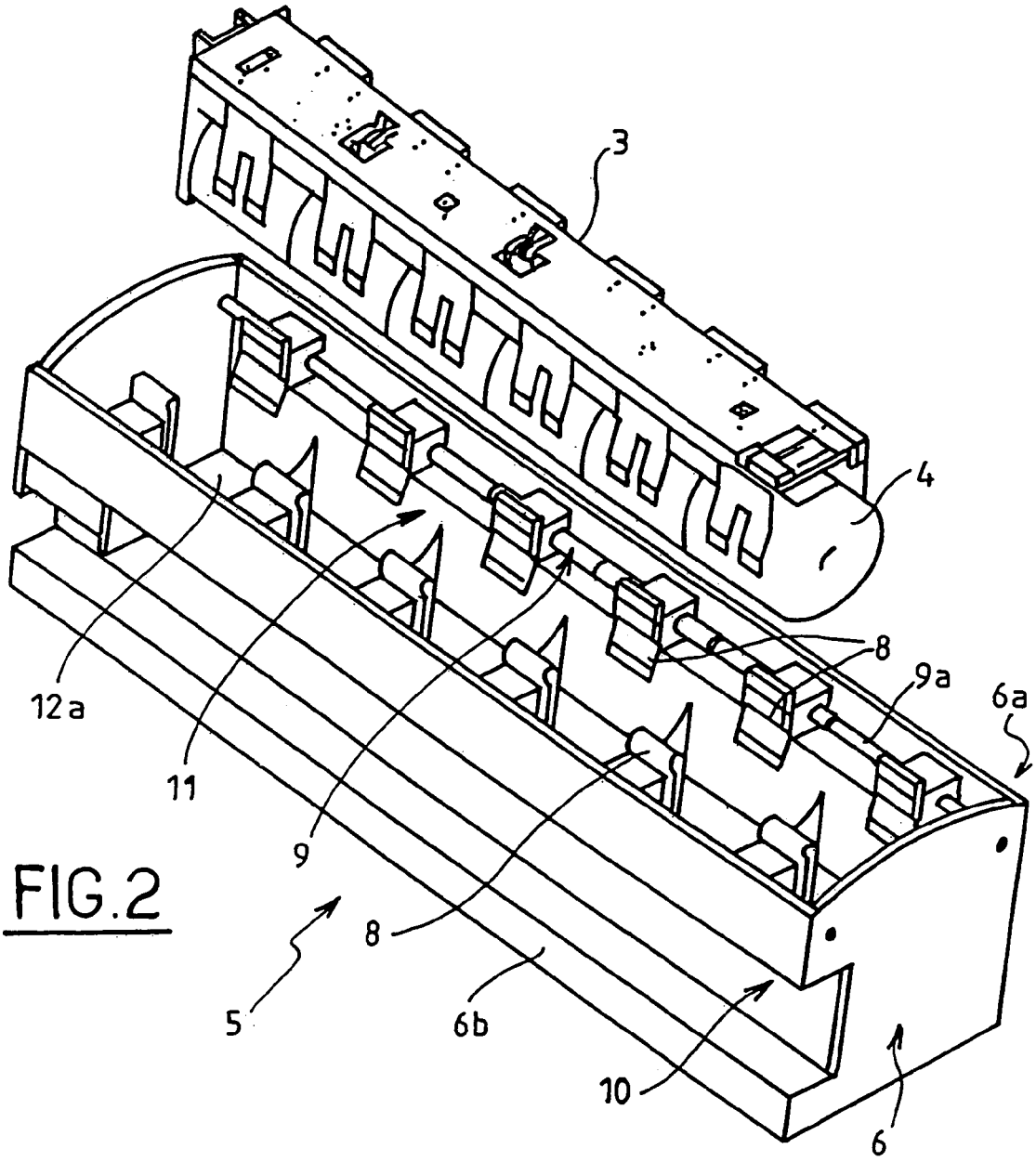
FIG. 2 shows a perspective view of the case containing the linking means, the separation means and the holding zone.

In FIG. 2, the case 6 is shown empty of modules. In this case 6, the reception and immobilizing means 11 are placed, as are the joining and separating means 9 and the selection zone 10. The case 6 is in the shape of a parallelepiped that has a lower lateral opening placed opposite the module joining means 7.

The reception and immobilizing means 11 are constituted by two rows of pincers 8 placed opposite each other and pressing on each module so as to immobilize it temporarily.

The pincers 8 forming each row are joined by joining and separation means 9. In this embodiment, the means 9 are constituted by a pair of screws 9*a*, 9*b* only one screw 9*a* of which may be seen in the drawing.

Both screws 9*a*, 9*b* are linked to the case 6 by their ends so as to ensure their rotation with respect to the case 6 in this embodiment.

Figure 8:
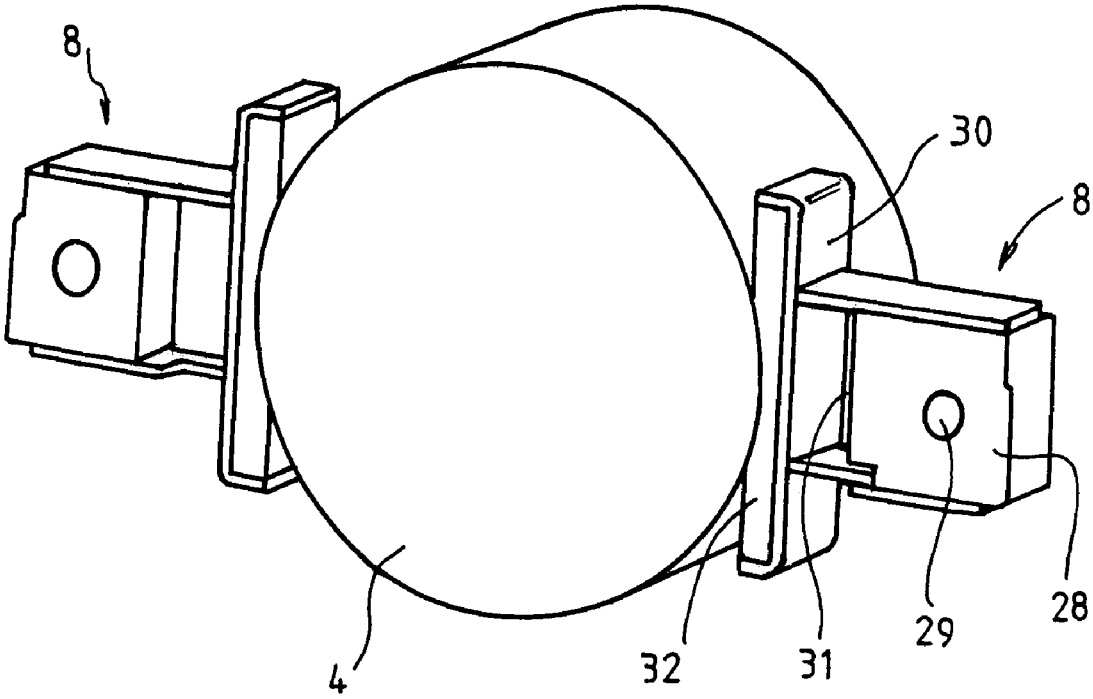
FIG. 8 shows a perspective view of a module held by a pair of pincers, the latter being show as partial sections.

Each pincer 8 is constituted by a pneumatic (or hydraulic) jack which is more particularly visible in FIG. 8.

The pincer 8 thus comprises a fixed body 28 incorporating female threading 29 receiving the joining and separating means 9. A mobile jaw 30 is able to translate with respect to the body 28. A housing 31 is placed between the mobile jaw 30 and the body 28. This housing receives a rubber bladder (not shown) linked to a pneumatic (or hydraulic) device. Inflating the bladder pushes the jaw 30 which comes to press on the charge module 4.

On its face pressing against the charge module, the jaw 30 has a rubber pad 32 with a V-shaped profile that reliably blocks the charge module without any risk of deterioration.

When, as seen in FIG. 8, two pincers placed opposite one another, are activated, they ensure the reliable retention of the charge module, when their bladders are deflated, the mass of the charge module acting on the V-shaped profiles is enough to push the jaws 30 on the jack body 28.

Figure 3:
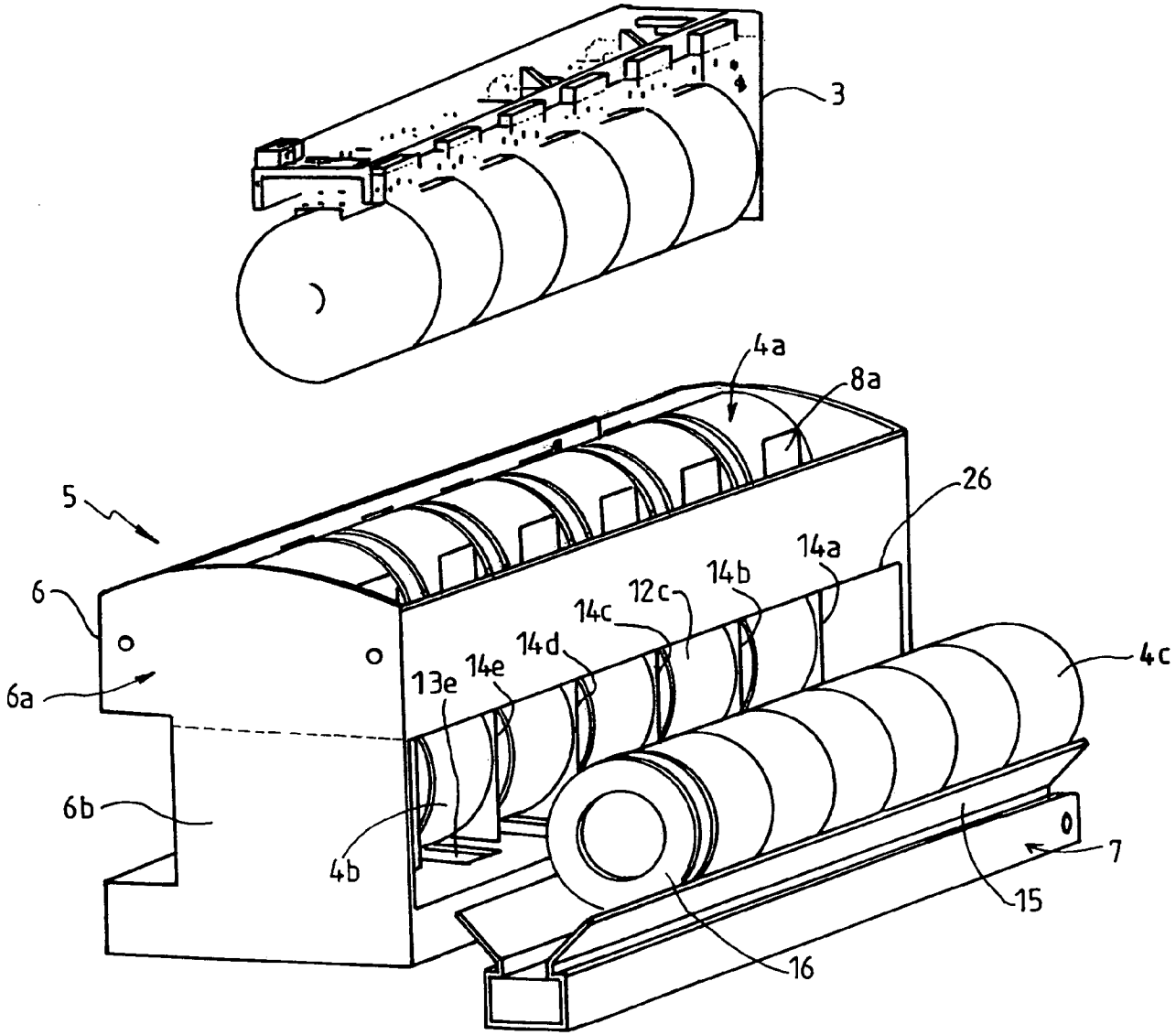
FIG. 3 shows another perspective view of the device according to the invention.

There are cells 12 in the lower part of the case 6 level with the selection zone 10, only one of which 12*a* is shown in the FIG. 2. Each cell 12 is intended to receive a module 4 one these have been separated from one another. Each cell 12 is provided with a plunger (not shown on the Figures), intended to push its corresponding module into the reception means 7 (FIG. 3). The set of plungers constitutes selection means for the modules 4. Such selection means incorporating plungers are the subject of patent U.S. Pat. No. 5,837,923 and it is thus unnecessary for them to be further described.

FIG. 3 shows the cooperation between the case 6 and the reception means 7 illustrating one step in the operation of the device 1. The case 6 wall opposite the magazine 1 is provided with a transversal opening 26 enabling the selected modules to be transferred to the reception means 7 placed in the near vicinity.

The device 5 according to the invention thus incorporates in this Figure a first series of modules 4*a* in the reception and immobilizing means 11 (upper part 6*a* of the case), another series 4*b* in the selection zone 10 (lower part 6*b* of the case), and finally a third one 4*c* in the reception means 7.

In the lower part 6*b*, modules 4*b* having been separated are isolated from one another by transversal walls 14*a* to 14*e* separating the cells 12, only one of which 12*c* is designated in the Figure. The bottom of each cell is pierced by openings 13, of which only one 13*e* is designated. These openings enable the passage of the plungers (not shown in the Figures).

The reception means 7 for the propellant charge modules 4 incorporate a chute 15 which consists of a V-shaped chute. This shape ensures the axial centering of the modules 4*c*. Indeed, the modules 4 may be of variable length and diameter and the chute compensates for these variations so that it is possible for them to be joined.

The chute 15 is provided with joining means (not shown in this Figure) able to exert axial pressure on the modules so as to nest them inside one another. The chute 15 is provided with a fixed counter-buffer (not shown) intended to retain the bottom of the last module and a mobile buffer intended to push the top of the first module. A cylinderless jack (not shown) placed under the chute provides the required thrust.

Figure 4:
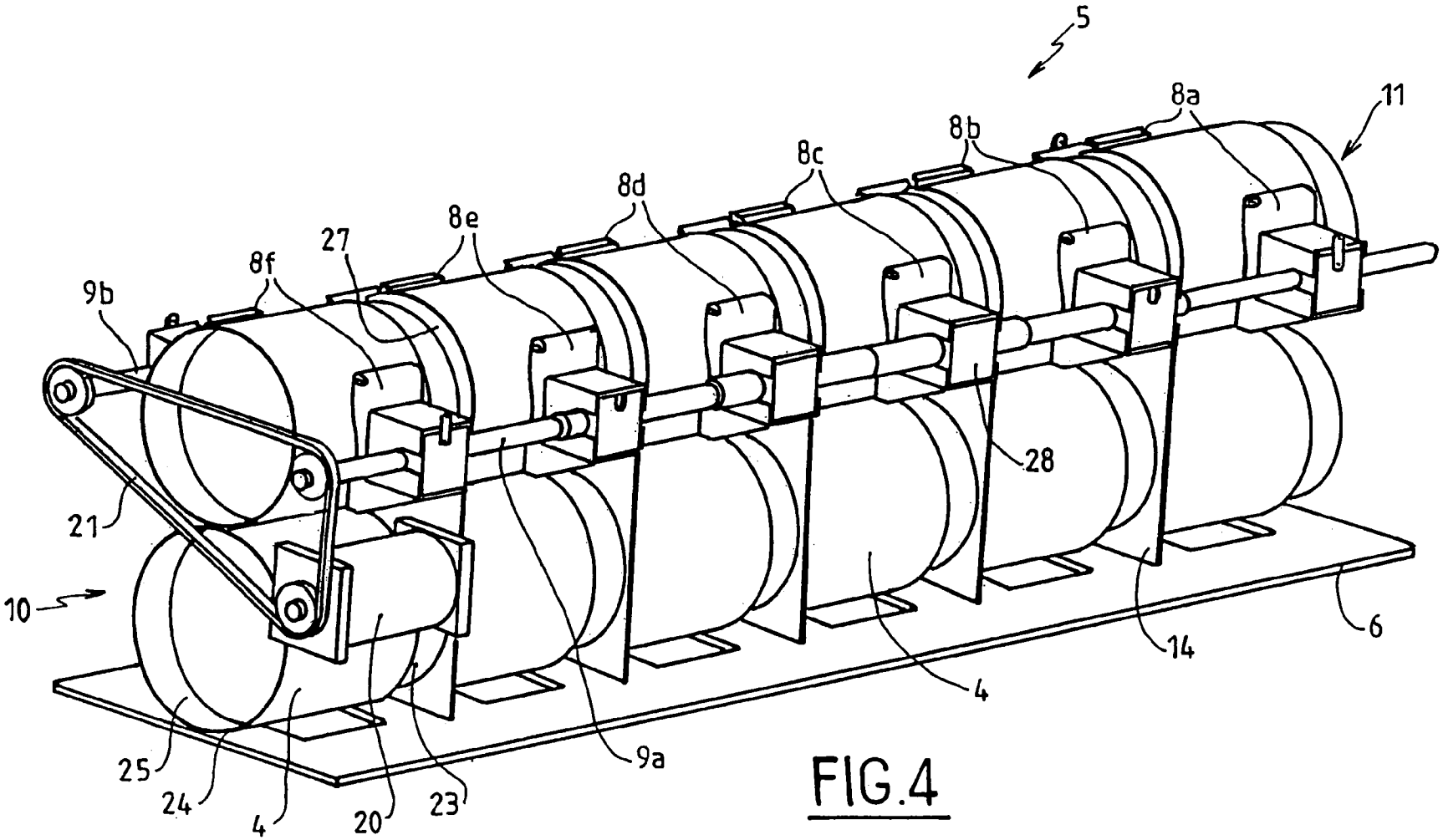
FIG. 4 shows another perspective view of the inside of the case.

FIG. 4 shows the details of the embodiment of the elements inside the case 6, comprising the reception and immobilizing means 11 for the modules, the joining and separation means 9 and the selection zone 10, each being filled with propellant charge modules.

Each module 4 is held by a pair of pincers 8*a* to 8*f*, and each row of pincers is furthermore joined by the module joining and separating means 9.

Figure 7:
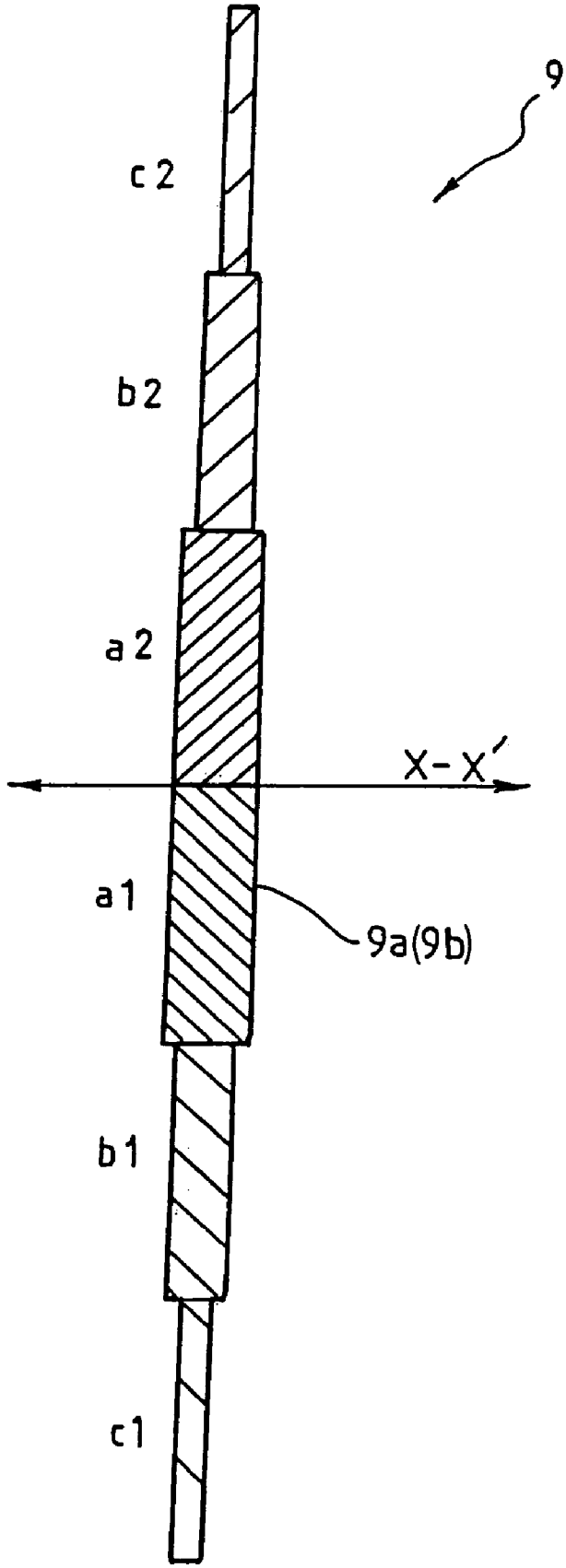
FIG. 7 shows a schematic external view of the module separation means.

In the embodiment shown in FIG. 4, the joining and separating means 9 consists of the two screws 9*a*, 9*b* whose structure is shown in FIG. 7. The two screws 9*a*, 9*b* are driven in rotation by a motor 20 (integral with the case), by means of a belt 21.

The Figure shows that the modules 4 in the top part are separated by a space 27, that is to say the joining and separating means 9 has been activated for separation. After the jaws of each pair of pincers have been moved apart, the separated modules drop into the selection zone 10 at the bottom of the case 6. Given the short distance separating the upper 6*a* and lower 6*b* parts of the case 6, this drop presents no risk. Each module is isolated from the adjacent modules 4 by walls 14. This Figure shows the structure of the modules 4, which have a top 23, a body 24 and a bottom formed of a cylindrical wall 24.

The external diameter of the top 23 is the same as the internal diameter of the wall 24. The modules 4 are thus able to nest inside one another.

Thus, the joining and separating means 9 enables a relative translation of the module with respect to another module 4 so as to separate them. The modules 4 thus being separated from one another, it is possible for the required number of modules to be selected in order to fire a projectile from the weapon. This selection is carried out using a selector 10 such as that described in patent FR-5837923.

Figure 5:
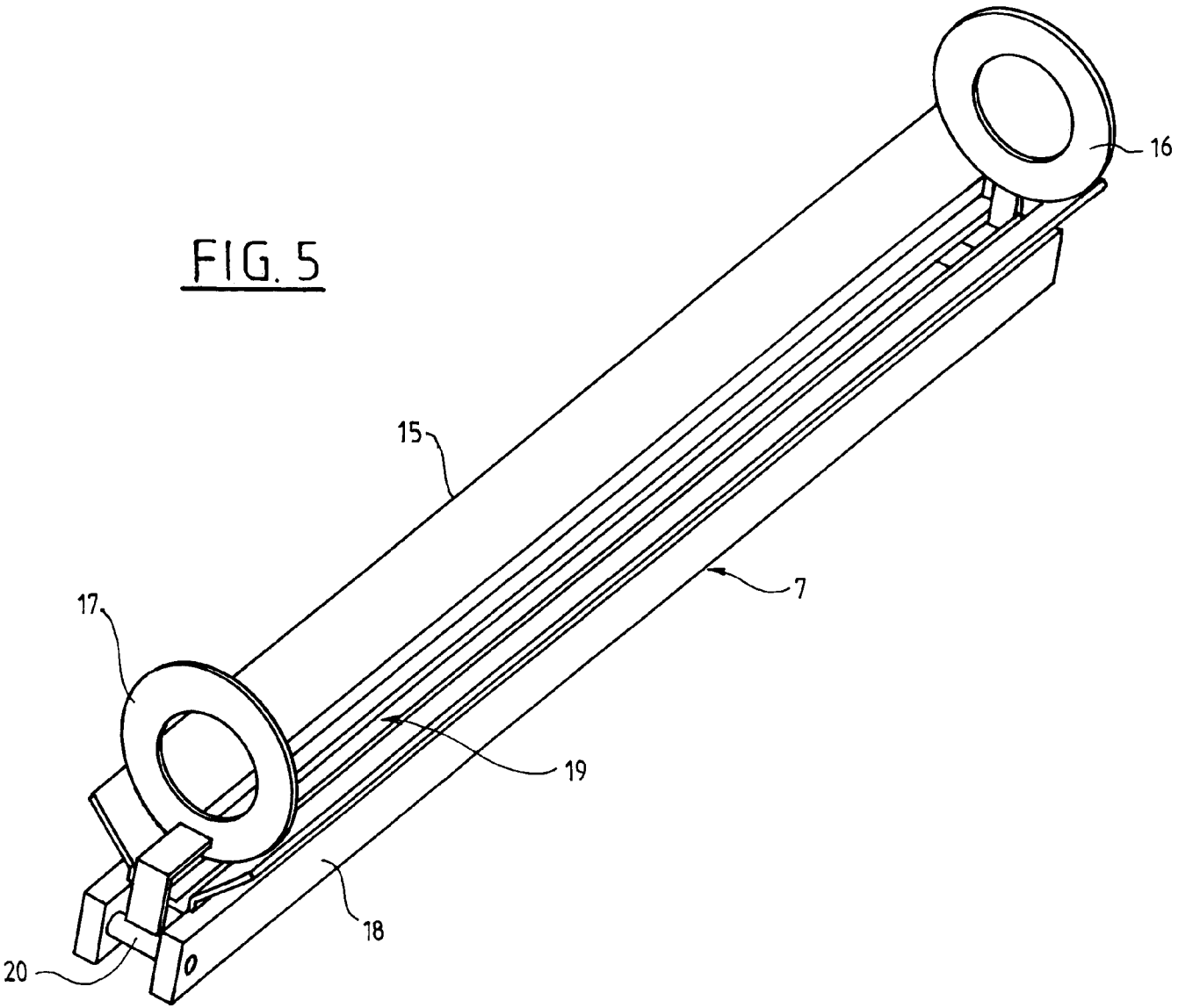
FIG. 5 shows a perspective view of the joining means for the modules, excluding the modules.
Figure 6:
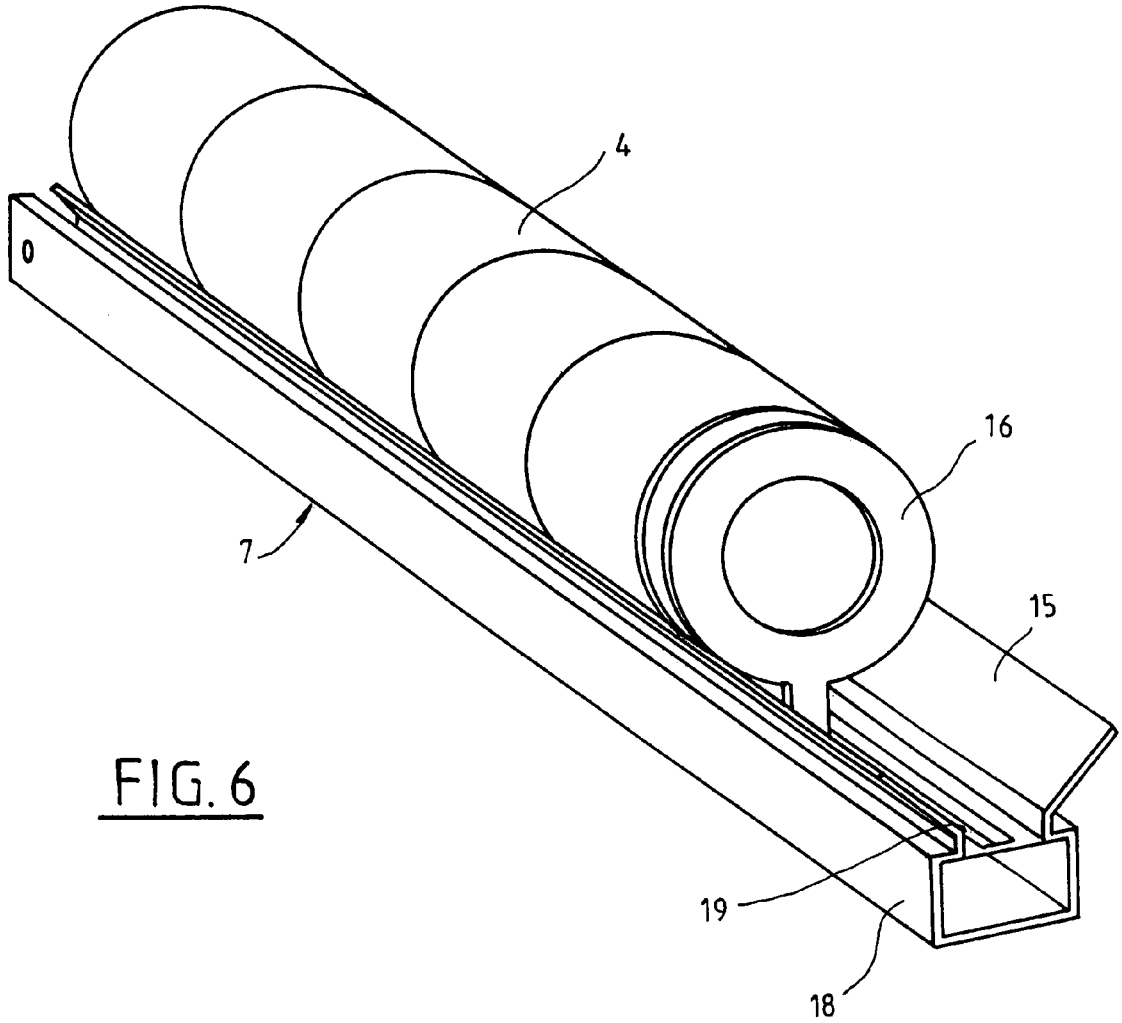
FIG. 6 shows a perspective view of the same module joining means including a set of modules.

FIGS. 5 and 6 show the reception means 7, respectively without and with modules.

In FIG. 5, the reception means 7 incorporates the V-shaped chute 15. This shape ensures the axial centering of the modules. The chute 15 is mounted on a base 18, provided with a central groove 19 in which a mobile buffer 16 slides. A counter-buffer 17 immobile in translation is linked to the base 18 by a shaft 20 allowing the counter-buffer 17 to tip over with respect to the base 18.

The counter-buffer 17 may be tipped by an actuator (not shown). Once tipped, it enables the passage of the propellant charge modules pushed by the mobile buffer which then transfers them to a loading arm of the weapon.

The fixed counter-buffer 17 is made here in the shape of a crown whose external diameter is slightly less than the diameter of the bottom 25 of the module 4. The counter-buffer 17 has an axial hole. Such an arrangement avoids pressure being exerted on the module's ignition means, which are generally placed along the axis. A cylinderless jack (of a classical type, not shown) is positioned in the support 18 and drives the mobile buffer 16 in translation.

FIG. 6 shows the joining means carrying five propellant charge modules 4 which have been joined once again to allow them to be inserted into the weapon chamber (not shown). The mobile buffer 16 has thus slid to push the modules 4 into one another so as to engage the top 23 of one module 4 into the bottom 25 of another module 4.

FIG. 7 is a schematic external view of an endless screw 9*a* (9*b*) that forms the joining and separation means illustrating its structure. Each screw 9*a*, 9*b* is constituted by a first set of three threaded shanks a1, b1, c1 of a different pitch but all in the same direction and a second set of three threaded shanks a2, b2, c2 of a different pitch but all in the direction opposite to that of the first set.

Thus, shank a1 has a pitch p to the right whereas shank a2 has a pitch p to the left. Shank b1 has a pitch 3*p* to the right and shank b2 has a pitch 3*p* to the left. Shank c1 has a pitch 5*p* to the right and shank c2 has a pitch 5*p* to the left.

Furthermore, the diameters of shanks c1, c2 are less than those of shanks b1, b2 which in turn are less than those of shanks a1, a2. These differences in diameter enable the body 28 of the pincers 8 to be screwed onto the screw 9*a* despite the differences in pitch.

Each shank thus receives a pincer 8 and rotating the joining and separating means 9 drives a displacement of the six different pincers.

Thanks to the different pitches and opposite directions, at each turn the screws 9*a*, 9*b* of the joining and separating means 9, the pincers move away from one another. In the embodiment envisaged in FIGS. 9*a* and 9*b*, and by way of example, the end pincers 8 linked to threaded shanks c1, c2 translate for a distance that is five times that of the central pincers 8 linked to threaded shanks a1, a2. Furthermore, the middle pincers 8 linked to threaded shanks b1, b2 translate for a distance that is three times that of the pincers 8 linked to threaded shanks a1, a2. In this case, the separation of the modules 4 requires very little rotation of the joining and separating means 9, for example, two turns.

Thus, when the screws 9*a* of the joining and separating means 9 are turned, the pincers 8 integral with the threaded shanks a1, a2 move away by a distance d because of the inverted pitches of shanks a1, a2. The shank is made to pivot at an angle that is enough for this distance d to allow the charge module placed on either side of a median plane XX' to come apart.

At the same time, the pincers 8 integral with shanks b1, b2 move away from the pincers 8 integral with shanks a1, a2 respectively by a distance also equal to d. Indeed, the pitch of shanks b1, b2 are equal to three times that of the pitch p of shanks a1, a2 this results, for a given rotation, in a displacement of the pincers 8 linked to shanks b1, b2 three times that of the displacement of the pincers 8 linked to shanks a1, a2.

The displacement of the pincer 8 linked to a1 with respect to the plane XX' is equal to d/2, therefore that of the pincer 8 linked to b1 is of 3d/2. And the differential gap between these two pincers 8 is thus equal to 3d/2−d/2=d. The modules 4 placed on either side of shanks a, b are thus pulled apart simultaneously with those on either side of a median plane XX'.

In an identical manner, the pincers 8 integral with shanks c1, c2 move away from the pincers 8 integral with shanks b1, b2 respectively by a distance also equal to d. The pitch of shanks c1, c2 is equal to 5 times the pitch of shanks a1, a2. The differential gap between the pincer linked to c1 and that linked to b1 is thus equal to 5d/2−3d/2=d.

This structure of the joining and separating means 9 thus enables a simultaneous separation of the six propellant charge modules 4 which are all moved apart from one another by the same distance. The device according to the invention operates as follows. The handling means 3 picks up, from the magazine 1, six modules nested in each other, conveys them above the device 5, as shown in FIG. 2, and engages them in the upper part 6*a* of the case, as shown in FIG. 3. The pairs of pincers 8 are then made to tighten so as to immobilize each module 4. The screws 9*a*, 9*b* of the joining and separating means 9 are then rotated to cause the respective translation of the modules 4 with respect to one another.

Figure 9A:
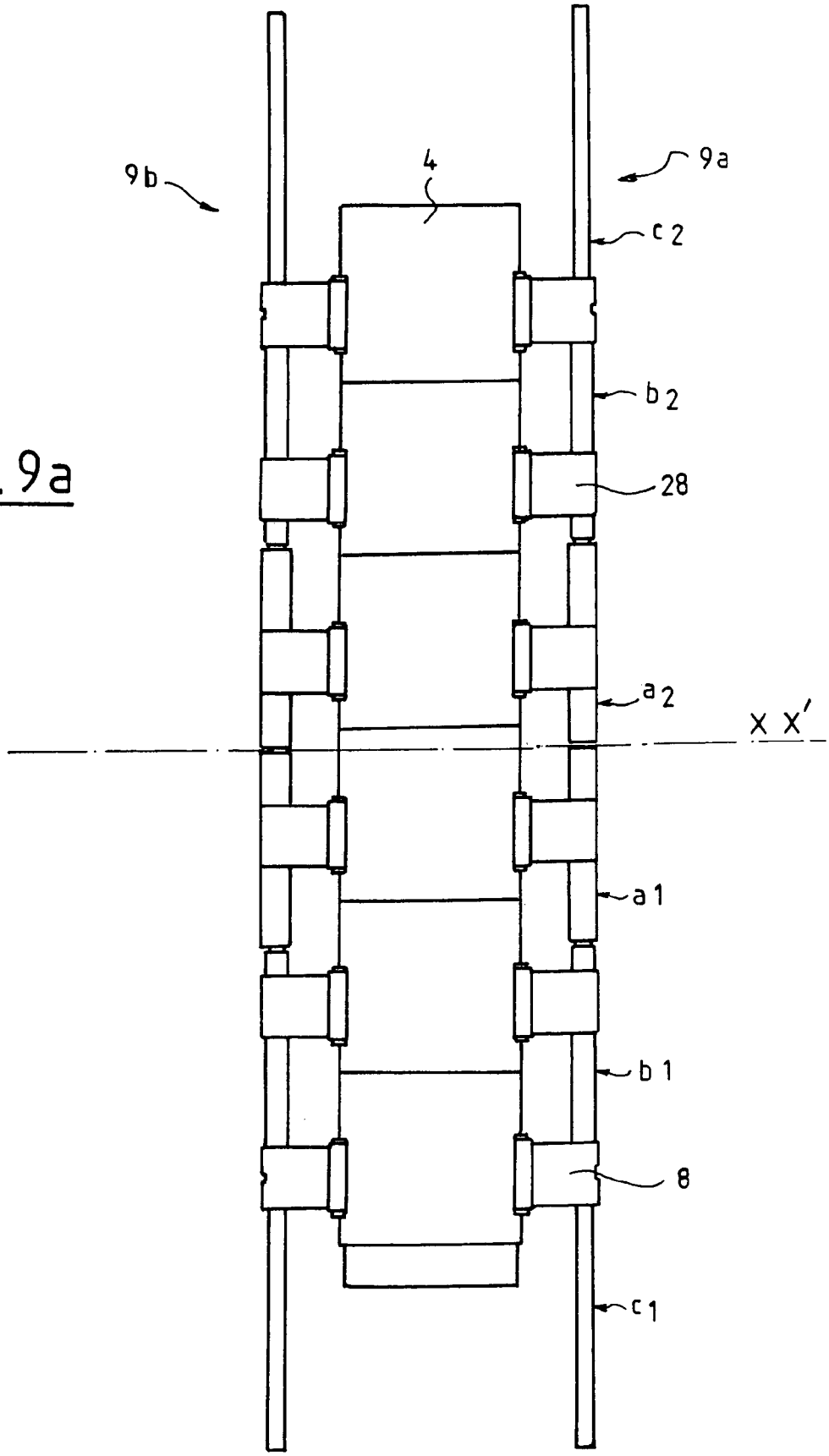
FIGS. 9*a* and 9*b* are two top views of the separation means, showing in FIG. 9*a* the modules in their linked position and in FIG. 9*b* showing them in their separated position.
Figure 9B:
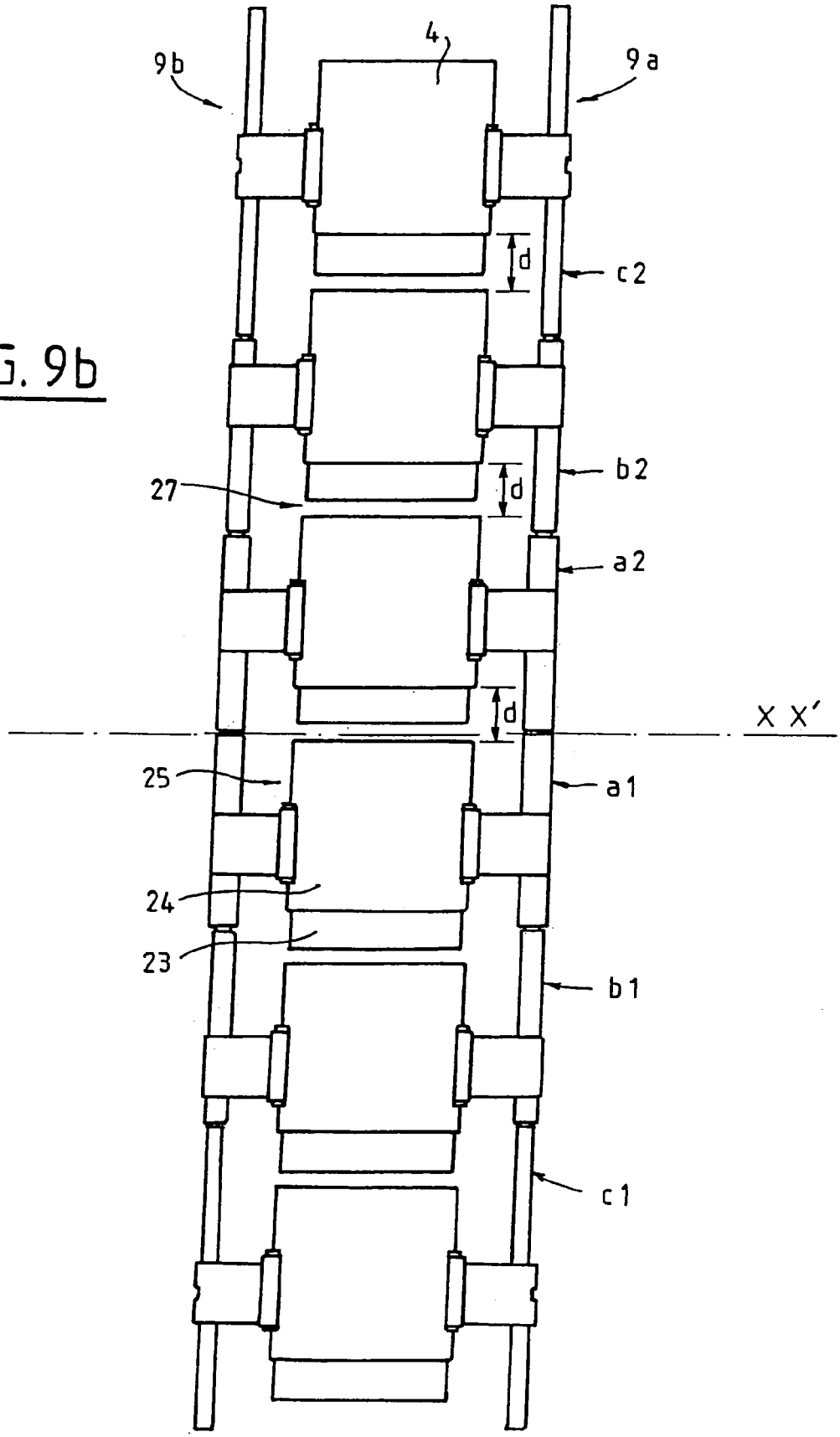

FIGS. 9*a* and 9*b* are top views of the device showing, in FIG. 9*a*, the pincers 8 holding the modules 4 in their joined position and, in FIG. 9*b*, the modules disconnected after rotation of the screws 9*a*, 9*b*. It can be observed that the gap between the different modules is the same after separation.

Once the modules 4 have been separated as seen in FIG. 4 (upper part), the pincers 8 are made to move apart and the separated modules 4 drop into the selection zone 10 as may also be seen in FIG. 4. In the selection zone 10, which houses the module selection means, the selected modules 4 are made to tip over into the reception means 7 whose mobile buffer 16 is in the end position with respect to counter buffer 17. The mobile buffer 16 is made to translate so as to engage the top 23 of one module into the bottom 25 of the adjacent module. For construction reasons, the number of modules 4 selected is never less than the number of modules 4 conveyed to the device according to the invention. Thus, the number of modules selected in the embodiment described is between 3 and 6.

Naturally, all these operations may be made using a programmable

What is claimed is:

1. A device to separate propellant charge modules for field weapons, each module incorporating a top and bottom, the top of one of said modules being engaged in the bottom of an adjacent module, said device comprising:

reception means for all said modules;

immobilizing means for immobilizing each of said modules; and linking and separating means for linking with said immobilizing means to thereby enable a relative translation to be controlled for each module with respect to its neighbors, thereby ensuring the separation of said module from one another.

2. The device according to claim 1, wherein said immobilizing means comprise a set of pairs of pincers placed on either side of one of said modules, each of said modules being held by a pair of pincers, said pair of pincers being controlled in translation by said linking and separating means.

3. The device according to claim 2, wherein said linking and separating means comprise rotating means and two screws parallel to said modules and incorporating a threaded shank opposite each of said modules carrying a pincer, each of said screws being linked to drive the rotating means.

4. The device according to claim 3, wherein each of said screws comprises a first group of threaded shanks each having a different pitch in the same direction, and another group of threaded shanks each having a different pitch in the same direction, but in the opposite direction to those of said first group, the number of said threaded shanks being the same as the number of said modules.

5. The device according to claim 4, wherein said threaded shanks in each group are of different diameters, end shanks having a smaller diameter than that of intermediate shanks whose diameter is less than that of median shanks.

6. The device according to claim 3, wherein said pincer is constituted by a jack incorporating a body integral with said threaded shank and a jaw able to move with respect to said body.

7. The device according to claim 1, wherein said modules are transferred into a selection zone incorporating selection means for said modules that tip the selected modules of said modules into reception means.

8. The device according to claim 7, wherein said linking and separating means and said selection zone are arranged in a same case.

9. The device according to claim 7, wherein said selection zone is provided with transversal walls defining a number of cells equal to the number of said modules separated by said separation means.

10. The device according to claim 7, wherein said modules are dropped into said selection zone.

11. The device according to claim 7, wherein said selection means for said modules are constituted by a set of pushers, each pusher being selectively controlled.

12. The device according to claim 7, wherein said reception means incorporate a reception bucket for individual modules, whose shape is such that said shape ensures the coaxial centering of said modules.

13. The device according to claim 12, wherein said reception means are provided with means to assemble said modules able to engage the top of one of said modules into the bottom of an adjacent module.

14. The device according to claim 13, wherein said module assembly means comprise a buffer able to move under the action of a jack and a fixed counter-buffer.

15. The device according to claim 14, wherein said fixed counter buffer may be tipped over with respect to said reception means.

* * * * *